US005575250A

United States Patent [19]

Van Dyne, II

[11] Patent Number: 5,575,250

[45] Date of Patent: Nov. 19, 1996

[54] QUICK DISCONNECT COUPLING FOR FLUID FLOW CONNECTIONS

[75] Inventor: G. L. Van Dyne, II, Aurora, Colo.

[73] Assignee: PROK Performance Enterprises, Inc., Denver, Colo.

[21] Appl. No.: 427,290

[22] Filed: Apr. 21, 1995

[51] Int. Cl.[6] ..... F02M 35/10

[52] U.S. Cl. ..... 123/184.46; 123/184.21

[58] Field of Search ..... 123/184.32, 184.46, 123/184.23, 184.39, 184.21, 184.54, 184.59

[56] References Cited

U.S. PATENT DOCUMENTS

| | | | |
|---|---|---|---|
| Re. 27,378 | 5/1972 | Lohn | 123/184.46 |
| 986,605 | 3/1911 | Svagell et al. | 281/105 |
| 1,263,570 | 4/1918 | Chapelle et al. | 281/16 |
| 1,640,291 | 8/1927 | Perkins | 281/105 |
| 2,340,071 | 1/1944 | Maher | 48/192 |
| 3,338,223 | 8/1967 | Williams | 48/192 |
| 3,903,646 | 9/1975 | Norton | 48/192 |
| 3,975,468 | 8/1976 | Tuckey | 123/184.39 |
| 5,203,296 | 4/1993 | Hart | 123/198 |

FOREIGN PATENT DOCUMENTS

| | | | |
|---|---|---|---|
| 1169313 | 6/1984 | Canada | 123/184.46 |
| 781437 | 5/1935 | France . | |

*Primary Examiner*—David A. Okonsky

*Attorney, Agent, or Firm*—John L. Isaac

[57] ABSTRACT

A quick disconnect coupling is disclosed for releasably interconnecting first and second fluid flow members each having a fluid opening. The coupling includes a base member having a bottom surface, an annular attachment collar defining an inner fluid port axially through the base member and including an outer cylindrical side wall, and an annular shoulder surrounding the attachment collar. A mechanism is provided for mounting the base member bottom surface to the first fluid flow member in order to align the fluid port with the fluid opening of the first fluid flow member. A connecting plate is further provided having a top and bottom surface and a central aperture defining an inner cylindrical sleeve sized for journaling about the collar side wall for limited rotation thereabout. The connecting plate also includes an inner annular shoulder disposed along the bottom surface radially outwardly of the sleeve, the connecting plate upper surface being adapted for connection to the second fluid flow member. A spring device is positioned on the base member annular shoulder and is adapted for resilient compression between the annular shoulders when the connecting plate is journaled about the attachment collar. Finally, a locking mechanism releasably locks the connecting plate to the base member and includes art interacting tongue and groove assembly adapted interengagement upon rotation of the plate about the collar with the spring means biasing the plate axially away from the base member to exert an axial force against the tongue and groove assembly.

24 Claims, 4 Drawing Sheets

FIG. 9
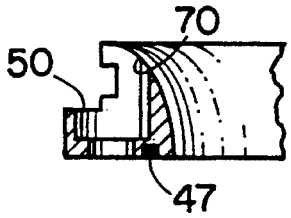
FIG. 6
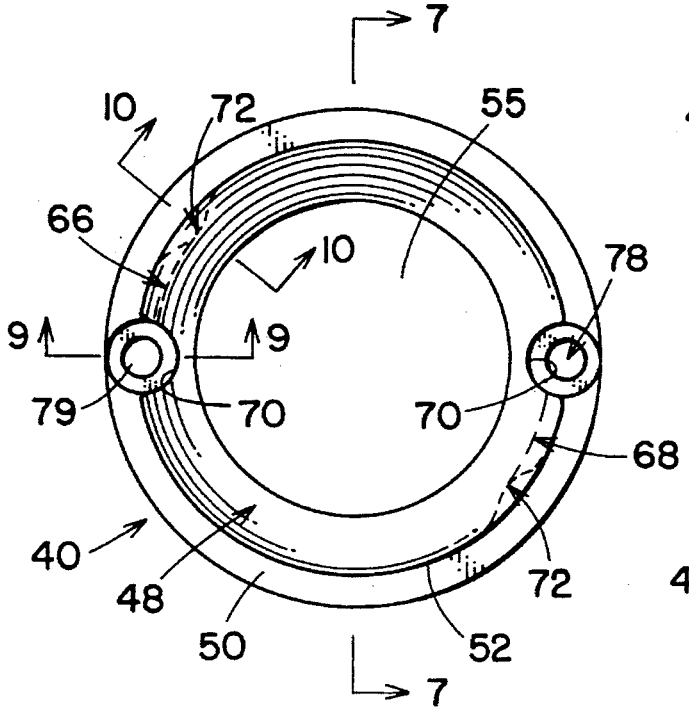
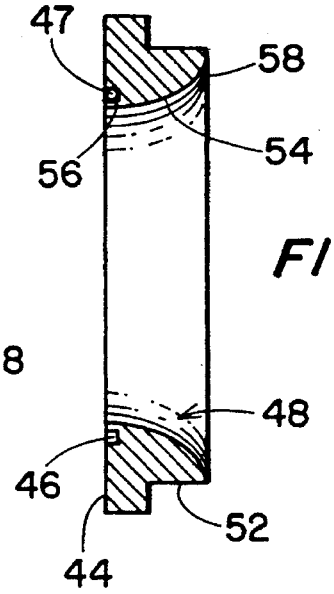
FIG. 7
FIG. 8
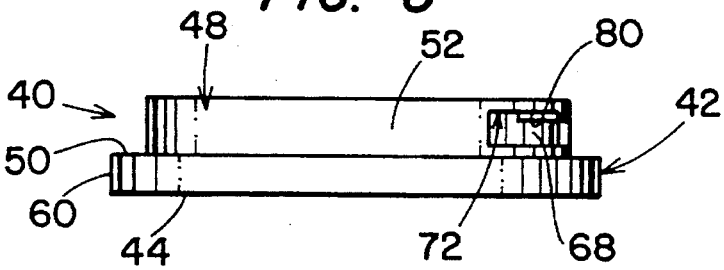
FIG. 10
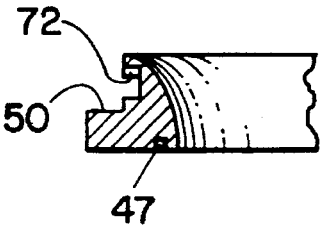

QUICK DISCONNECT COUPLING FOR FLUID FLOW CONNECTIONS

BACKGROUND OF THE INVENTION

1. Field of the Invention

The present invention relates generally to coupling devices and, more particularly, to coupling devices designed for interconnecting two fluid flow members for either gas or liquid. Specifically, the present invention relates to a quick disconnect coupling arrangement for attaching two fluid flow members in a high vibration environment.

2. Description of the Prior Art

Coupling devices for fluid flow systems are well known in the art. This is true whether the fluid is a liquid such as water or gasoline, or a gas such as air or carbon monoxide. One such environment that incorporates fluid flow coupling connectors is the internal combustion engine. Examples of such fluid flow connectors can be found in either the carburetor system, the exhaust manifold, the fuel delivery system, and the like. In each of these instances, a fluid, either gaseous or liquid, is delivered to or removed from the engine via delivery lines, and coupling members must interconnect such lines to the internal combustion engine.

Because of the high vibration experienced in such internal combustion engine environments or other coupling applications, coupling members or devices are generally attached utilizing screw or bolt mechanisms to ensure a continuous tight coupling connection. This is particularly true in engine environments for sports vehicles such as snowmobiles, motorcycles and jet skis. In these particular applications, the devices, and thus the engine and its component connection members, are subjected to extremely high vibration. Consequently, the connections must be made very tight thereby generally requiring tight bolting systems. Unfortunately, such tight bolting systems make the removal of coupling devices for engine maintenance or repair difficult and time consuming. However, the trade-off has heretofore always been in favor of the tight bolting connection as opposed to ease of removal for maintenance purposes.

One specific example of such an application is in the adaptation of flame arrestors or backfire preventors to the carburetors of such engines. Flame arrestors in sports vehicles such as motorcycles and watercraft are frequently utilized to prevent backfiring and the possibility of operator injury from such backfiring. Examples of flame arrestors or backfire preventors are illustrated in U.S. Pat. No. 986,605 and U.S. Pat. No. 1,640,291 as well as in French Patent No. 781,437. More specific flame arrestor arrangements are disclosed in U.S. Pat. No. 2,340,071, U.S. Pat. No. 3,903,646 and U.S. Pat. No. 5,203,296. In each of these references, the flame arrestor device is attached to the entrance of the carburetor by a bolting mechanism to securely fasten the flame arrestor device to the carburetor. Otherwise, the flame arrestor device might have a tendency to dislodge over a period of use due to vibration. Such dislodgment reduces the efficiency of the flame arrestor as well as permits backfire times to avoid the flame arrestor, which produces a safety hazard. Prior to the advent of the present invention, removal of the flame arrestors in order to service the carburetion system was difficult, time consuming and possibly complicated due to the potential of dropping parts into the throat of the carburetor as the flame arrestor is being unbolted. Thus, there is a need for a coupling system for interconnecting flame arrestors to such carburetor systems as well as for interconnecting other fluid flow members utilized in high vibration environments whereby the coupling device incorporates a quick disconnect feature without having to remove bolts and other parts.

SUMMARY OF THE INVENTION

Accordingly, it is one object of the present invention to provide a coupling device for fluid flow members that does not require the use of bolts or the like for attachment.

It is another object of the present invention to provide a quick connect and disconnect coupling member for interconnecting fluid flow members.

Yet another object of the present invention is to provide a coupling device particularly useful in high vibration environments and applications.

A further object of the present invention is to provide a flame arrestor assembly for use with a carburetor that has a quick connect and disconnect capability.

To achieve the foregoing and other objects and in accordance with the purpose of the present invention, as embodied and broadly described herein, a quick disconnect coupling is disclosed for releasably interconnecting first and second fluid flow members each having a fluid opening. The coupling includes a base member having a bottom surface, an annular attachment collar defining an inner fluid port axially through the base member and including an outer cylindrical side wall, and an annular shoulder surrounding the attachment collar. A mechanism is provided for mounting the base member bottom surface to the first fluid flow member in order to align the fluid port with the fluid opening of the first fluid flow member. A connecting plate is further provided having a top and bottom surface and a central aperture defining an inner cylindrical sleeve sized for journaling about the collar side wall for limited rotation thereabout. The connecting plate also includes an inner annular shoulder disposed along the bottom surface radially outwardly of the sleeve, the connecting plate upper surface being adapted for connection to the second fluid flow member. A spring device is positioned on the base member annular shoulder and is adapted for resilient compression between the annular shoulders when the connecting plate is journaled about the attachment collar. Finally, a locking mechanism releasably locks the connecting plate to the base member and includes an interacting tongue and groove assembly adapted for interengagement upon rotation of the plate about the collar with the spring means biasing the plate axially away from the base member to exert an axial force against the tongue and groove assembly.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 6 is a top plan view of the base member portion of a coupling device constructed in accordance with the present invention;

FIG. 7 is a cross sectional view taken substantially along line 7—7 of FIG. 6;

FIG. 8 is a side elevation view of the base member illustrated in FIG. 6.;

FIG. 9 is a cross sectional view taken substantially along line 9—9 of FIG. 6;

FIG. 10 is a cross sectional view taken substantially along line 10—10 of FIG. 6;

DETAILED DESCRIPTION OF THE PREFERRED EMBODIMENT

Figure 1:
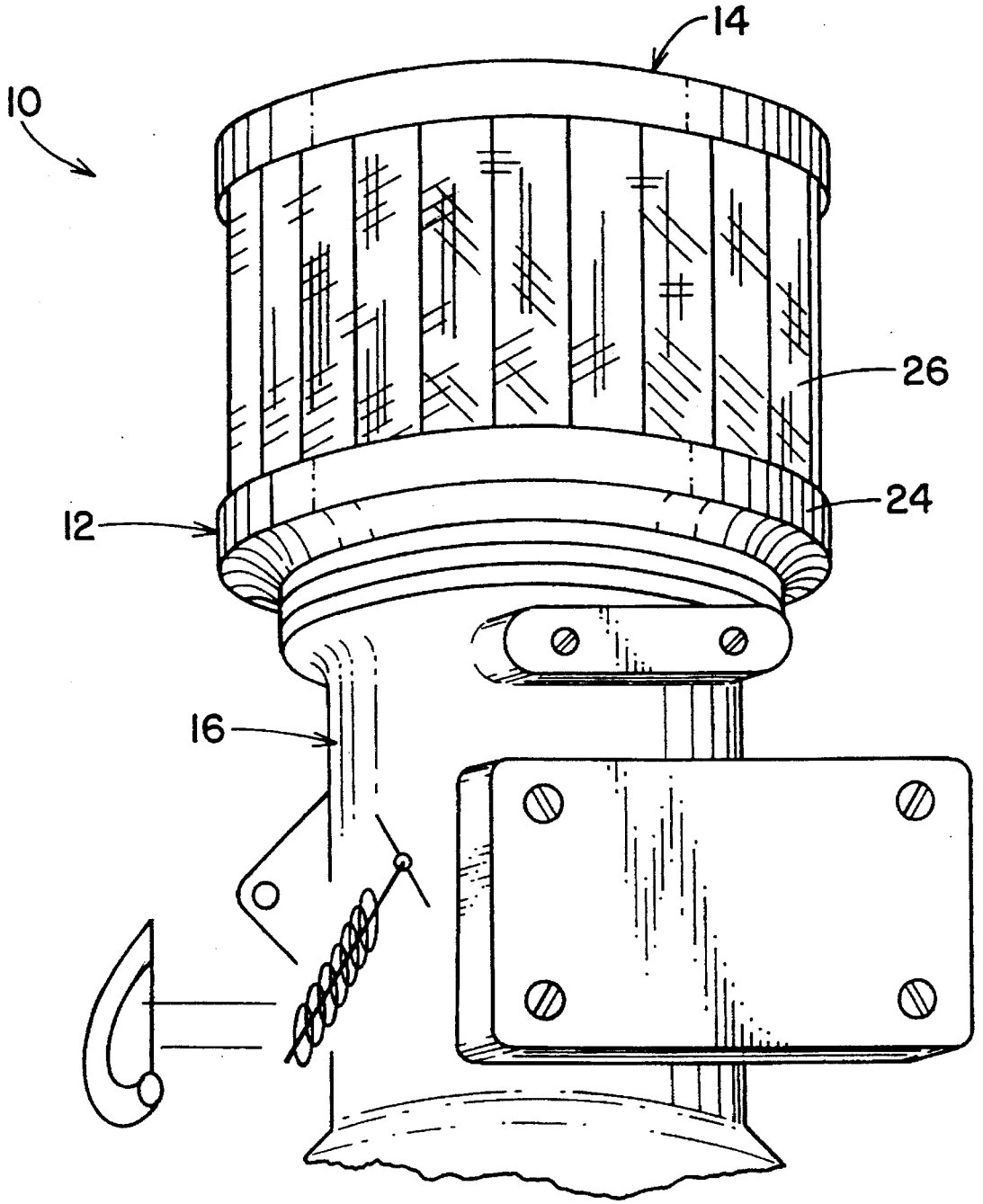
FIG. 1 is a side schematic view of a carburetor having a flame arrestor mounted thereto utilizing a coupling device constructed in accordance with the present invention.
Figure 3:
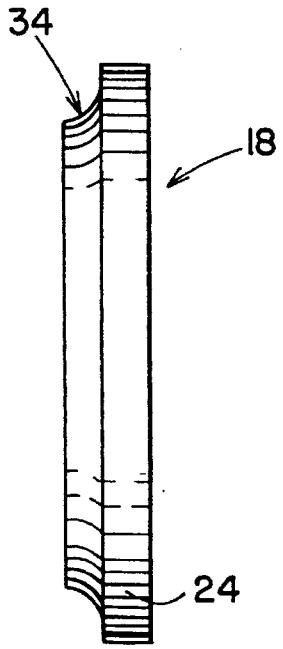
FIG. 3 is a side elevation view of the connecting plate illustrated in FIG. 2.
Figure 2:
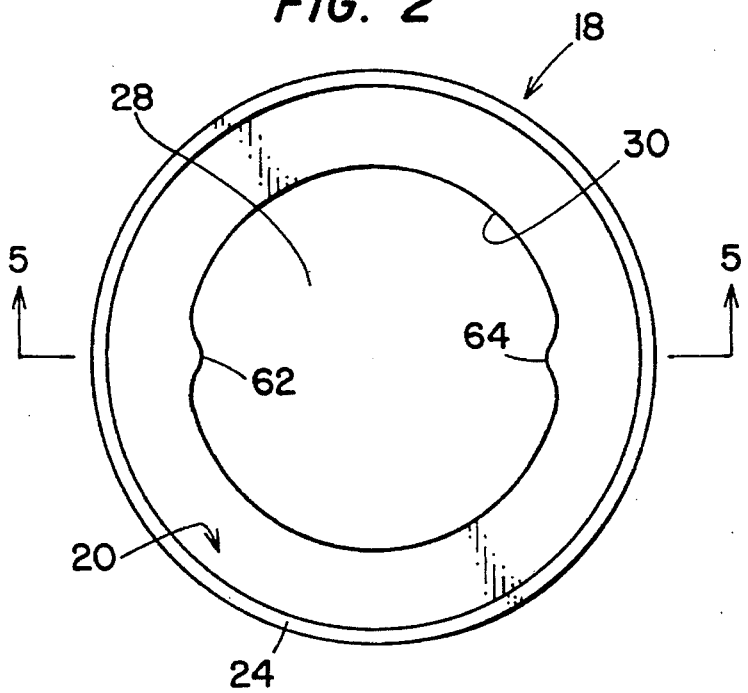
FIG. 2 is a top plan view of a connecting plate portion of the coupling device constructed in accordance with the present invention.
Figure 4:
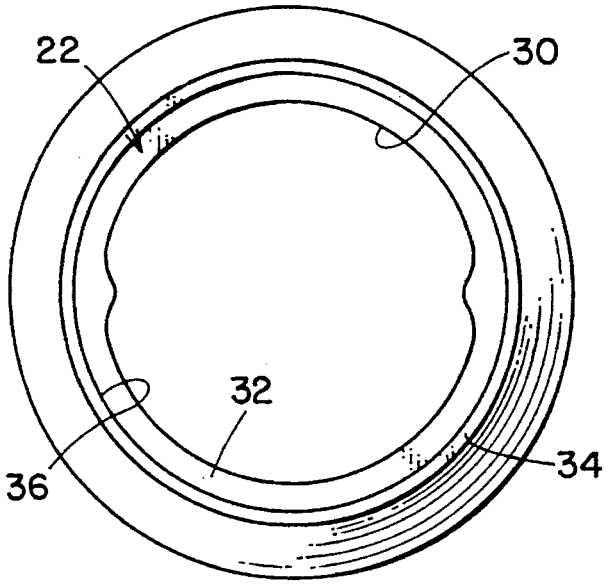
FIG. 4 is a bottom plan view of the connecting plate illustrated in FIG. 2.
Figure 5:
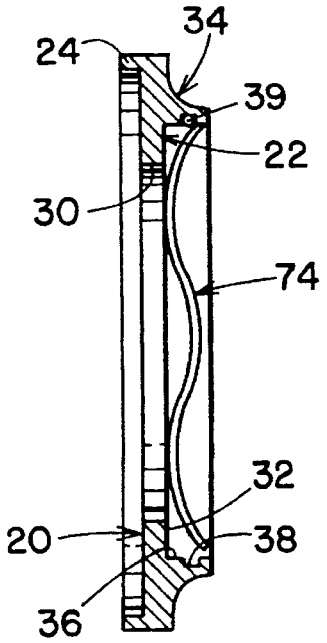
FIG. 5 is a cross sectional view taken substantially along line 5—5 of FIG. 2.
Figure 11:
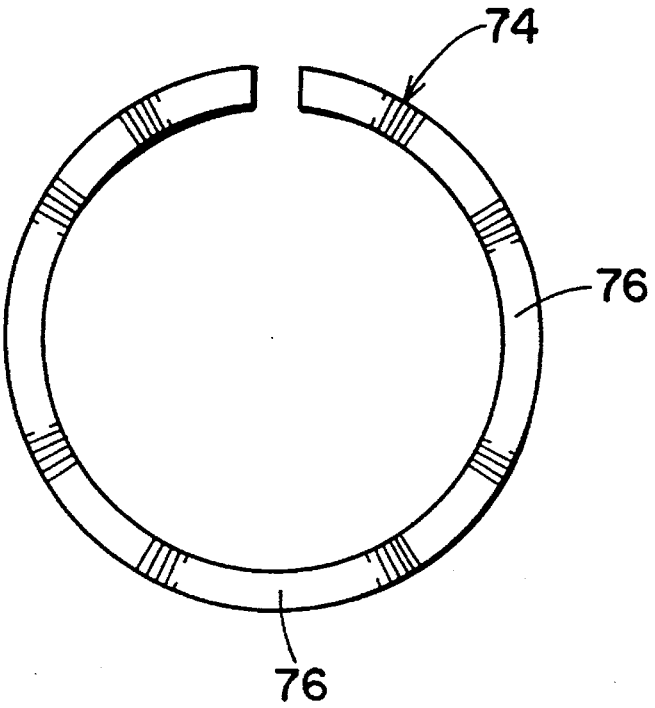
FIG. 11 is a top plan view of a spring member utilized in the coupling device constructed in accordance with the present invention.
Figure 12:
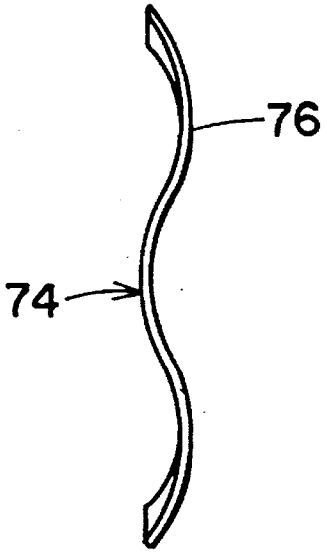
FIG. 12 is a side elevation view of the spring illustrated in FIG. 11.

Referring first to FIG. 1, a device 10 illustrates use of the coupling device 12 of the present invention for interconnecting a flame arresting element 14 with a carburetor 16. It should be understood that this particular illustration is simply use of many uses wherein the coupling device 12 of the present invention may be utilized to interconnect one fluid flow member, in this instance the flame arresting element 14, with a second fluid flow member, which in this instance is the carburetor 16. The flame arrestor element 14 may be of any standard design and may be mounted to the coupling device 12 as discussed below to interconnect with the carburetor intake of the carburetor 16. In this instance, the flame arresting element 14 functions as any other type of flame arrestor or backfire retarding device and is intended to prevent flames from being ignited in the carburetor throat and backfiring out into the atmosphere above the carburetor. Further details and functioning of the flame arrestor element 14 will not be described herein inasmuch as the flame arrestor 14 functions, as previously indicated, in the same manner as any other typical flame arrestor would function and is well described in the prior an references outlined previously.

Prior to the advent of the present invention, the flame arrestor 14 was typically bolted to the carburetor 16 thereby requiring bolts to pass through the flame arrestor 14 directly into the carburetor 16. Such prior art arrangements required the entire unbolting and disassembly of the flame arrestor 14 from the carburetor 16 in order to do simple maintenance on the carburetor. Moreover, the risk was always present of inadvertently dropping bolts or other type of screw connectors into the throat of the carburetor when attempting to remove the flame arresting element. The present invention obviates such complications and time consuming efforts.

Referring initially to FIGS. 1–5, the quick disconnect coupling 12 of the present invention includes two basic portions that are interconnected through a spring bias mechanism. The fast portion is a connecting plate 18 which includes an upper surface 20 and a bottom surface 22. The upper surface 20 preferably is surrounded by an annular rim 24 which assists in connecting the housing 26 of the flame arresting element 14 to the plate 18. Any means of connecting the flame arresting element or other fluid flow member to the plate 18 may be utilized depending upon the size and configuration of the flame arresting element member. Moreover, in other applications, the fluid flow member may have certain configurations requiring specific connections to the upper surface 20 utilizing the rim 24. Such modifications should become obvious in these specific applications.

The plate 18 includes a central aperture 28 which defines an inner sleeve 30 having a substantially cylindrical configuration. The sleeve 30 is sized for journaling about the base portion of the device 12 as described in greater detail below. An annular shoulder 32 preferably extends radially outwardly from the sleeve 30 along the bottom surface 22 of the plate 12.

In one embodiment of the present invention, a flange member 34 depends downwardly from the bottom surface 22 and includes an inner cylindrical wall 36. The flange 34 helps define the boundaries of the shoulder 32 between the inner cylindrical wall 36 of the flange 34 and the sleeve 30 The inner cylindrical wall 36, in one embodiment, includes a groove 38 in which an O-ring 39 or other sealing member may be placed.

Referring with particularity to FIGS. 6–10, the connecting device 12 of the present invention includes a second portion in the form of a base member 40. The base member 40 includes an annular base bottom portion 42 which has a bottom surface 44 that is designed for attachment to the carburetor 16 of the embodiment illustrated in FIG. 1. Likewise, the bottom surface 44 may be secured to any fluid flow device with which the coupling 12 is being utilized. In on embodiment of the present invention, the bottom surface 44 includes an annular groove 46 in which an O-ring 47 or other seating member may be placed to prevent seepage flow of liquid between the carburetor or second fluid flow member and the base member 40 junction.

The base member 40 also includes a raised annular collar or ring 48 that extends outwardly from the base bottom portion 42 and has a diameter less than that of the base bottom portion 42. Consequently, a shoulder 50 is formed between the annular collar or ring 48 and the base bottom portions 42, which shoulder is preferably sized congruently with the shoulder 32 of the connecting plate 18. The collar 48 preferably includes a sidewall 52 that is substantially cylindrical in shape and is sized and shaped to snugly fit with the sleeve 30 of the connecting plate 18. The inner throat 54 of the collar 48 defines a fluid port 55 and is curved so that the bottom diameter 56 proximate the bottom surface 44 is substantially less than the upper diameter 58 proximate the upper edge of the collar 48. This dimensioning of the throat 54 enables the bottom diameter 56 to be sized to match the carburetor intake throat of the carburetor 16. Clearly, the dimensioning of the throat 54 and the diameters 56, 58 hereof will be specific to the particular application depending upon the types and sizes of fluid flow members to which the coupling device 12 is being utilized to interconnect.

It should also be noted that the base bottom portion 42 of the base member 40 includes an outer cylindrical edge 60. The cylindrical edge 60 is sized and shaped to snugly fit with the cylindrical inner wall 36 of the flange 34 on the connecting plate 18. This connection between the cylindrical wall 36 and the annular edge 60 enables additional sealing between the base member 40,and the connecting plate 18 due to the O-ring 39 or other sealing member placed within the grooves 38 of the flange 34. Moreover, the firm interconnection between the inner wall 38 and the annular edge 60 enhances the snug attachment between the two components 18 and 40 of the coupling 12 to assist in vibration resistance between the two parts.

The connecting plate 18 is releasably interconnectible with the base member 40 by providing the preferred interlocking mechanism as described herein. The interlocking mechanism preferably includes tongue and groove assemblies in the form of at least two tongues or tabs 62, 64 which project radially inwardly from the sleeve 30 of the connecting plate 18. The tabs 62, 64 are preferably disposed opposite each other along the sleeve 30 and are in the form of curved knobs. While a pair of tabs 62, 64 are illustrated, it should be understood that additional pairs of oppositely disposed tabs may also be utilized. Likewise, a pair of circumferential channels or grooves 66, 68 are engraved or otherwise formed within the sidewall 52 of the attachment collar 48. A pair of matching notches 70 are provided in the sidewall 52 that are sized and shaped to receive the curved tongues or tabs 62, 64. Thus, the cylindrical sleeve 30 is journaled about the annular sidewall 52 with the tabs 62, 64 aligned at the notches 70. At this point, the plate 18 is pressed downwardly toward the base member 40 and then rotated clockwise so as engage the tabs 62, 64 within their respective channels 66, 68. Disposed at the distal end of each of the channels 66, 68 is an axially enlarged area 72 so that the circumferential grooves 66, 68 are in the form of a modified "L" with the enlarged portions at the distal ends thereof being enlarged axially away from the base bottom portion 42. In this manner, when the plate 18 has been inserted over the collar 48 and rotated so that the tabs 62, 64 have passed through the entire length of the channels 66, 68, the tabs 62, 64 lodge at the ends thereof in the enlarged distal area 72. These enlarged areas 72 provide a pocket in which the tabs 62, 64 may be seated when exposed to an axial force as described below To lock the tabs 62, 64 firmly within the pocket or seats 72, a spring 74 is provided. The spring 74 is preferably in the form of a wavy leaf spring and is sized and shaped to fit between the shoulder 50 of the base member 40 and the shoulder 32 of the connecting plate 18 when the plate 18 is inserted over the collar 48. The size of the undulations 76 of the spring 74 are adjusted to create a bias force whereby an axial compression between the connecting plate 18 and the base member 40 must be created to overcome the bias force of the spring 74 in order to permit the tabs 62, 64 to pass through the notches 70 a sufficient distance so as to be capable of engaging the channels 66, 68. Without this axial compressive force between the components 18 and 40, the tabs 62, 64 will not pass through the notches 70 a sufficient distance to enter the channels 66, 68.

Once the tabs 62, 64 have been moved through the channels 66, 68 by rotating the connecting plate 18 clockwise about the collar 52 so that they enter the pockets 72, the spring mechanism 74 biases or urges the tabs 62, 64 axially outwardly away from the base bottom portion 42 so as to firmly seat them within the pockets 72. In this manner, the tabs 62, 64 may not be dislodged from the seats 72 absent an axial compressive force between the components 18, 40 coupled with a counterrotation so as to move the tabs 62, 64 back into the channels 66, 68. Thus, simple vibration, even of a severe form will not dislodge the tabs 62, 64 from the pockets 72 inasmuch as the bias force of the spring 74 will maintain the tabs 62, 64 firmly within the pockets 72 and will prevent them from reentering channels 66, 68 absent an intentional compressive force between the components 18, 40 coupled with counterrotation of the plate 18. However, such an arrangement does permit quick connection and disconnection of he components 18 and 40 without the use of bolts or any other mechanism between the components 18, 40 of the coupling member 12.

The base member 40 may be attached to the carburetor 16 or other fluid flow member by any number of permanent attachment mechanisms and is preferably secured by providing a pair of apertures 78 which pass through the annular shoulder 50. The apertures 78 are preferably arranged opposite each other on said base member 40. In preferred form, the apertures 78 are aligned with the notches 70 so as to provide axial bores which pass through the notches 70 and the apertures 78. In this manner, any attachment member, such as a screw or a bolt 79, may be utilized by inserting them through the notches 70 and into the apertures 78 to firmly mount the base member 40 to the fluid flow member or carburetor 16. To prevent such attachment members from becoming dislodged and removed through vibration, the connecting plate 18 is preferably sized and shaped such that a portion of the plate 18 overlaps the notches 70 and apertures 78 so that the attachment members map not be dislodged and inadvertently enter the throat 54 and fluid port 55, which in turn could cause them to enter the carburetor 16 or other fluid flow member resulting in potential damage.

In operation of the present invention, the base member 40 is connected to the carburetor throat or other fluid flow member so that the fluid port 55 aligns with the opening in that fluid flow member. The leaf spring 74 is then positioned on the annular shoulder 50 so that it provides a barrier which must be compressed when the coupling device 12 is fully assembled. The connecting plate 18 is then positioned so that the sleeve 30 fits snugly about the sidewall 52 of the attachment collar 48 and the tabs 62, 64 are aligned with the notches 70. The connecting plate 18 is then axially compressed toward the base member 40 so as to compress the spring 74 sufficiently to allow the tabs 62, 64 to come into an alignment with their respective circumferential channels 66, 68. The connecting plate 18 is then rotated clockwise a limited amount so that the tabs 62, 64 enter the channels 66, 68 and reach the distal ends thereof. At this point, the compressive force against the plate 18 toward the base member 40 is released. When this occurs, the bias force of the spring 74 urges the shoulders 50, 32, thereby seating the tabs 62, 64 into the pockets 72. Due to the overlap portion 80 between the pocket 72 and the channels 66, 68, the tabs 62, 64 cannot be turned in either a clockwise or counterclockwise direction since the tabs 62, 64 are no longer directly aligned with the channels 66, 68. In this manner, the coupling 12 can be exposed to severe vibrations without dislodging the interlocking mechanism between the connecting plate 18 and the base member 40.

When it is desired to detach the connecting plate 18 and any member carried thereby from the base member 40 and any member connected thereto, an axial compressive force between the plate 18 and the base member 40 of sufficient strength to overcome the bias of the spring 74 is exerted so as to align the tabs 62, 64 once again with the channels 66, 68 and bypass the overlap of the lip 80. At this juncture, the plate 18 rotated in a counter-clockwise manner so that the tabs 62, 64 reenter the channels 66, 68 to where they align with the notches 70. The connecting plate 18 may then be removed from about the collar 48 to disconnect the coupling 12.

As can be seen from the above, the coupling device of the present invention enables for rapid connection and disconnection of two fluid flow members without the necessity of using bolts or the like for such interconnection. By avoiding prior an types of connections, considerable time is saved with fewer complications. Moreover, there are no additional parts that may be lost as a result of the removal of bolts or screws in order to disconnect the coupling member as is the case of prior art devices. In addition, the present invention is virtually vibration resistant due to the interlocking mechanism between the component parts of the coupling device. Consequently, the present invention is highly desirable for use in interconnecting fluid flow members such as a flame arresting element on a carburetor in such high vibration environments as jetskis, motorcycles, snowmobiles and the like. Since the coupling device 12 of the present invention is preferably constructed from aluminum, the coupling member 12 is extremely lightweight yet very resistant to wear and damage.

A coupling device 12 was constructed in accordance with the present invention as described above and was tested for compliance performed with a marine flame arrestor. The test was performed at the Automotive Laboratory of the University of Detroit. Three test specimens were constructed of the same dimension, that is 3 15/16 inch diameter by 2 ½ inches height. The connecting plate diameter was 3 inches. The connecting plate and base members were machined from cast aluminum. The test samples differed only in the number of layers of 18×18 mesh 0.011 inch diameter wire cloth that comprised the flame arresting elements utilized for testing purposes. The 2, 3 and 4 layer elements were formed in a folded arrangement with an inner layer of perforated metal in standard format.

The test procedure utilized was patterned after SAE J 1928 standard procedure. Each specimen was attached to a matching carburetor and was subjected to a simple harmonic vibration with a double amplitude of 0.040 inch for a period of eight hours in each of three mutually perpendicular directions. In each of the eight hours of vibration testing, the frequency was varied from 10 to 60 Hertz in four minute cycles.

After the vibration tests, the same specimens were then subjected to an explosion test. For this explosion test, the specimen and carburetor, with carburetor plates in a full open position, was mounted on the open end of a 2 inch nominal water pipe 24 inches long. The opposite end of the pipe was closed and equipped with a provision for a supply of combustible mixture and an ignition source. The combustible mixture consisted of 100 cfh of air and 500 cfh of propane. This mixture was established prior to the test to produce the maximum combustion pressure for a given flow rate.

The trial consisted of igniting the flowing mixture. The resulting combustion wave propagated up the pipe through the carburetor and the test specimen potentially igniting the combustible mixture that surrounded the test specimen. This latter combustible mixture was formed by collecting the flowing mixture between trials in a Plexiglas chamber 12 inches in diameter and 12 inches tall. This chamber had a provision for a pressure relieving cover. The interval between trials was 28 seconds. A strain gauge pressure transducer was mounted in the wall of the pipe approximately 2 inches below the base of the carburetor. This transducer was used to monitor the combustion pressure. The signal from the transducer was condition, amplified in a peak and hold circuit, and then presented on a digital display. After every tenth trial, a second ignition source in the upper chamber was activated to ensure the combustibility of the chamber mixture.

All three specimens, that is the 2, 3 and 4 layer specimens, were subjected to the 24 hours of vibration. Upon completion of these tests, there was no evidence on any of the specimens that they had even experienced the test. In other words, there was no visible evidence whatsoever of loosening of the coupling device of the present invention.

The 2 layer specimen was then exposed to the explosion test described above. It successfully contained 55 consecutive trials to which is was subjected. In other words, the coupling maintained a firm connection between the flame arresting element and the carburetor so that the flame arrestor successfully contained the explosive mixture in 55 successive explosion trials. Because of the remarkable success of the 2 layer unit, the 3 and 4 layer units were not tested in the explosion test. It was determined that based on prior experience and the immense success of the 2 layer flame arrestor unit, the 3 and 4 layer flame arrestor units would also be successful.

The combustion pressure data applied during the test was as follows:

1. maximum value—6.1 psig
2. minimum value—1.6 psig
3. average value—3.64 psig.

Based on the above tests, it was concluded that the 2 layer flame arrestor utilizing the quick disconnect coupling device constructed in accordance with the present invention fully complied with the SAE J 1928 standard procedure.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

We claim:

1. A quick disconnect coupling for releasably interconnecting first and second fluid flow members each having a fluid opening, said coupling comprising:

a base member having a bottom surface, an annular attachment collar defining an inner fluid port axially through said base member and including an outer cylindrical side wall, and an annular shoulder surrounding said attachment collar;

means for mounting said base member bottom surface to said first fluid flow member to align said fluid port with the fluid opening of said first fluid flow member;

a connecting plate having a top and bottom surface and a central aperture defining an inner cylindrical sleeve sized for journaling about said collar side wall for limited rotation thereabout, and an annular shoulder disposed along said bottom surface radially outwardly of said sleeve, said connecting plate upper surface being adapted for connection to said second fluid flow member;

spring means positioned on said base member annular shoulder and adapted for resilient compression between said annular shoulders when said connecting plate is journaled about said attachment collar; and means for releasably locking said connecting plate to said base member including interacting tongue and groove means adapted for interengagement upon rotation of said plate about said collar, said spring means biasing said plate axially away from said base member to exert an axial force against said tongue and groove means.

2. The coupling as claimed in claim 1, wherein said tongue and groove means comprises at least two tongue and groove assemblies disposed on said coupling, each said assembly including a notch disposed in the side wall of said collar, a groove in the form of a channel extending circumferentially from said notch along said collar side wall, and a tongue projecting radially inwardly from the cylindrical sleeve of said plate sized and shaped to pass through said notch and engage said channel as said plate is journaled on and rotated about said collar.

3. The coupling as claimed in claim 2, wherein each said channel is axially enlarged at its distal end to form a pocket extending axially outwardly from said base member bottom surface to provide a seal for said tongue to lock said plate onto said collar, said tongue being biased into said seat by said spring means.

4. The coupling as claimed in claim 3, wherein each said channel is substantially in the form of an "L" with the leg thereof forming said pocket.

5. The coupling as claimed in claim 2, wherein each said notch comprises an axial bore passing through said collar side wall.

6. The coupling as claimed in claim 5, wherein said base member mounting means comprises a pair of apertures disposed on opposite sides of said base member and extending axially through said base member annular shoulder, and a pair of attachment members sized for passing through said apertures and attaching to said first fluid flow member, each said base member aperture being axially aligned with one said axial bore.

7. The coupling as claimed in claim 6, wherein said connecting plate is dimensioned so that it covers at least a portion of said base member axial bores and axial apertures when said plate is in its locked position on said collar to prevent inadvertent loss of said attachment members.

8. The coupling as claimed in claim 6, wherein said spring means comprises a wavy annular leaf spring member sized and shaped for sandwiched positioning between said shoulders to require axial compression thereof between said plate and collar to overcome the bias of said spring member to permit each said tongue to be engaged within its respective channel.

9. The coupling as claimed in claim 1, wherein said base member bottom surface includes sealing means for preventing fluid flow exterior to said first fluid member fluid opening and said fluid port.

10. The coupling as claimed in claim 1, wherein said spring means comprises a wavy annular leaf spring member sized and shaped for positioning between said annular shoulders when said plate is journaled about said collar, said leaf spring member being adapted to biasly urge said shoulders apart.

11. A vibration resistant connector mechanism for releasably interconnecting first and second fluid flow members, each having a fluid opening used in conjunction with an internal combustion engine, said connector mechanism comprising:

a base having a bottom portion for attachment to said first fluid flow member, a coupling ring projecting above said bottom portion and having an outer cylindrical side wall, said ring defining an inner fluid port, and an annular shoulder surrounding said ring at said bottom portion;

means for mounting said base to said first fluid flow member to align said fluid port with the fluid opening of said first fluid flow member;

a connecting plate having a top and bottom surface and a central aperture defining an inner cylindrical sleeve, sized for mounting about said ring side wall for limited rotation thereabout, an inner annular shoulder disposed along said bottom surface radially outwardly of said sleeve substantially congruent in size with said base annular shoulder, said connecting plate upper surface being adapted for connection to said second fluid flow member to align said central aperture with the fluid opening of said second fluid flow member;

spring means adapted for positioning between said substantially congruent shoulders for resilient compression therebetween when said connecting plate is mounted about said attachment ring for interconnection therewith; and means for releasably locking said connecting plate to said base to resist vibration disengagement thereof including at least two tongue and groove assemblies positioned opposite each other on said connector mechanism for interlocking said plate with said base upon rotation of said plate about said attachment ring, said spring means biasing said plate axially outwardly from said base to exert an axial locking force against said tongue and groove assemblies.

12. The connector mechanism as claimed in claim 11, wherein each said tongue and groove assembly includes a notch disposed in the side wall of said coupling ring, a groove in the form of a channel extending circumferentially from said notch along said ring side wall, and a tongue in the form of a curved tab projecting radially inwardly from the cylindrical sleeve of said plate sized and shaped to pass through said notch and engage said channel as said plate is journaled on and rotated about said ring.

13. The connector mechanism as claimed in claim 12, wherein each said channel is axially enlarged at its distal end and is substantially in the form of an "L" to form a pocket extending axially outwardly from said base member to provide a seat for said tab to lock said plate onto said ring, said tab being biased into said seat by said spring means.

14. The connector mechanism as claimed in claim 12, wherein each said notch comprises an axial bore passing through said ring side wall.

15. The connector mechanism as claimed in claim 14, wherein said base mounting means comprises a pair of apertures disposed on opposite sides of said base and extending axially through said base annular shoulder, and a pair of attachment members sized for passing through said apertures and attaching to said first fluid flow member, each said base aperture being axially aligned with one said notch.

16. The connector mechanism as claimed in claim 14, wherein said connecting plate is dimensioned so that it covers at least a portion of said coupling ring notches when said plate is in its locked position on said coupling ring.

17. The connector mechanism as claimed in claim 11, wherein said spring means comprises a wavy annular leaf spring member sized and shaped for positioning between said annular shoulders, said leaf spring member being adapted to biasly urge said annular shoulders apart.

18. A quick disconnect flame arrestor device for an internal combustion engine having a carburetor and a carburetor air intake, said device comprising:

a housing containing a flame arresting element, means for providing air flow into said flame arresting element, and an exit duct for providing air flow out of said element into said carburetor air intake;

a connecting plate having a top surface for mounting said housing, a bottom surface and a central aperture aligned with said exit duct for air flow therethrough, said central aperture defining an inner cylindrical sleeve and an annular shoulder disposed along said bottom surface radially outwardly of said sleeve;

a base member including a bottom surface, an annular attachment collar having an outer cylindrical side wall and defining an inner fluid port therethrough, and an annular shoulder surrounding said collar;

means for mounting said base member to said carburetor to align said fluid port with said carburetor air intake;

spring means positioned between said annular shoulders and adapted for resilient compression therebetween when said connecting plate is journaled about said collar, said sleeve being sized for mounting about said collar side wall for limited rotation thereabout and for aligning said carburetor air intake, said fluid port, said central aperture and said exit duct to provide an air path between said carburetor air intake and said flame arresting element; and means for releasably locking said connecting plate to said base member to prevent vibration disengagement of said housing from said carburetor, said locking means including interacting tongue and groove means adapted for interengagement upon rotation of said plate about said collar with said spring means biasing said plate axially away from said base member to exert an axial locking force against said tongue and groove means to prevent unintentional counterrotation thereof.

19. The device as claimed in claim 18, wherein said tongue and groove means comprises at least two sets of tongue and groove assemblies disposed opposite each other on said coupling, each said set of assemblies including a notch disposed in the side wall of said attachment collar, a groove in the form of a circumferential channel extending from said notch along said collar side wall, and a tongue in the form of a curved tab projecting radially inwardly from the cylindrical sleeve of said plate sized and shaped to pass through said notch and engage said circumferential channel as said plate is journaled on and rotated about said collar, said spring means requiring compression by said plate in order to enable engagement of said tab with said channel.

20. The device as claimed in claim 19, wherein each said circumferential channel is in the form of a circumferential "L" shape having its distal end in the form of a pocket extending axially outwardly from said base member to provide a seat for said tab to lock said plate onto said collar, said tab being biased into and maintained within said seat by said spring means.

21. The device as claimed in claim 19, wherein each said notch comprises an axial bore passing through said attachment collar side wall and is aligned with said mounting means in said base member.

22. The device as claimed in claim 21, wherein said mounting means comprises a pair of apertures disposed on opposite sides of said base member and extending axially through said base member annular shoulder, and a pair of attachment members sized for passing through said apertures and attaching said base member to said carburetor aligning said carburetor air intake with said inner fluid port.

23. The device as claimed in claim 22, wherein said connecting plate is dimensioned so that it covers at least a portion of said notches and said mounting means when said plate is in its locked position on said collar to prevent inadvertent loss of said attachment members into said carburetor air intake.

24. The device as claimed in claim 18, wherein said spring means comprises a wavy annular leaf spring member sized and shaped for positioning between said shoulders to require axial compression thereof between said plate and said collar to overcome the bias of said spring member to permit interengagement of said tongue and groove means.

* * * * *